US006202629B1

(12) United States Patent
Zhu et al.

(10) Patent No.: US 6,202,629 B1
(45) Date of Patent: Mar. 20, 2001

(54) ENGINE SPEED GOVERNOR HAVING IMPROVED LOW IDLE SPEED STABILITY

(76) Inventors: G. George Zhu, 1147 Junco Dr.; Albert E. Sisson, 3600 Deerfield Pl., both of Columbus, IN (US) 47203

( * ) Notice: Subject to any disclaimer, the term of this patent is extended or adjusted under 35 U.S.C. 154(b) by 0 days.

(21) Appl. No.: 09/323,462

(22) Filed: Jun. 1, 1999

(51) Int. Cl.[7] ..... F02D 41/14
(52) U.S. Cl. ..... 123/339.21; 123/352; 123/357
(58) Field of Search ..... 123/339.19, 339.21, 123/352–358; 701/104

(56) References Cited

U.S. PATENT DOCUMENTS

| | | | | |
|---|---|---|---|---|
| 4,245,599 | | 1/1981 | Des Lauriers | 123/353 |
| 4,307,690 | | 12/1981 | Rau et al. | 123/353 |
| 4,423,485 | | 12/1983 | Sami et al. | 701/104 |
| 4,577,604 | | 3/1986 | Hara et al. | 123/397 |
| 4,719,572 | | 1/1988 | Kishimoto | 701/104 |
| 4,836,166 | | 6/1989 | Wietelmann | 123/358 |
| 4,879,673 | | 11/1989 | Nagase et al. | 702/100 |
| 4,928,653 | | 5/1990 | Ohkubo et al. | 123/435 |
| 4,957,086 | | 9/1990 | Sasaki et al. | 123/478 |
| 5,067,461 | | 11/1991 | Joachim et al. | 123/357 |
| 5,153,446 | | 10/1992 | Shimomura | 290/40 C |
| 5,165,271 | | 11/1992 | Stepper et al. | 73/116 |
| 5,222,022 | * | 6/1993 | Adams et al. | 123/352 X |
| 5,231,965 | | 8/1993 | Muzzy | 123/325 |
| 5,235,949 | | 8/1993 | Wahl et al. | 123/359 |
| 5,367,462 | | 11/1994 | Klenk et al. | 701/104 |
| 5,495,835 | | 3/1996 | Ueda | 123/339.11 |
| 5,553,589 | | 9/1996 | Middleton et al. | 123/352 |
| 5,609,136 | | 3/1997 | Tuken | 123/357 |
| 5,662,085 | * | 9/1997 | Aubourg et al. | 123/352 |
| 5,669,351 | | 9/1997 | Shirai et al. | 123/339.21 |
| 5,685,270 | | 11/1997 | Sekiguchi et al. | 123/339.21 |
| 5,771,861 | | 6/1998 | Musser et al. | 123/357 |
| 5,775,304 | * | 7/1998 | Kono et al. | 123/357 X |

* cited by examiner

*Primary Examiner*—Terry M. Argenbright

(57) ABSTRACT

A system and method for controlling the speed of an engine, or a speed governor, receives an error signal indicative of the difference between the actual engine speed and a commanded engine speed. This error signal is passed through a linear controller that determines a fuel flow rate in units of volume per unit time. The fuel flow rate is a substantially linear function of engine speed, and more specifically engine speed error. The output of the linear controller is fed to a non-linear compensator that determines a fueling command signal as a non-linear function of actual engine speed and fuel flow rate. The speed governor can accurately control engine speeds at low idle conditions. In one embodiment, the non-linear compensator utilizes a three-dimensional table of fueling command values as a function of fuel flow rate and engine speed. In another embodiment, the compensator applies a transfer function utilizing low and high calibration speed values enveloping a low engine speed. In another feature of the invention, a speed sensing system applies a zero order sample and hold to a sensor pulse train to generate a preliminary speed signal. This preliminary speed signal is fed to a software-based first order sample and hold component that calculates an integrated error value, leading to a speed signal value that is substantially free from frequency aliasing.

17 Claims, 4 Drawing Sheets

ENGINE SPEED GOVERNOR HAVING IMPROVED LOW IDLE SPEED STABILITY

BACKGROUND OF THE INVENTION

The present invention relates generally to systems for controlling engine speed in an internal combustion engine. More specifically, the invention concerns systems and methods for accurately maintaining engine speed at low idle speeds.

Engine speed control systems, commonly known as engine speed governors, are well known in the automotive industry. In one type of engine speed governor, commonly known as a cruise control, a constant vehicle speed is maintained for a user-defined input. In this cruise control, or isochronous application, the engine speed is maintained constant regardless of the torque load applied to the vehicle engine.

A typical engine speed control system is depicted in FIG. 1. Specifically, an engine 10 includes a fuel control system 12 that controls the amount of fuel provided to the engine. The speed of the engine is directly proportional to the quantity of fuel thus provided. The engine 10 can include a speed sensor 15 that produces a signal on signal line 16 corresponding to the actual engine speed, $N_{ACT}$. In a typical engine, engine speed is measured using a pulse train generated by a toothed tone wheel and magnetic pickup arrangement. The magnetic pickup signal is pre-processed by an analog circuit that converts the signals into a pulse train. This pulse train is then fed to a counter/timer, typically included within an engine control module (ECM) 20. This counter/timer calculates the elapsed time between tone wheel pulses, and the angular velocity is calculated as the known angular spacing between teeth divided by the elapsed time. For use in various engine control routines, the result of this operation can be further conditioned to produce the actual engine speed signal $N_{ACT}$. Details of a suitable engine speed sensor system can be found in U.S. Pat. No. 5,165,271, which disclosure is incorporated herein by reference.

In accordance with this engine control system, an engine control module 20 receives a variety of inputs, including the engine speed signal $N_{ACT}$. In addition, the ECM 20 receives a second signal on line 28 that is produced by a throttle position sensor 29. More particularly, the throttle position sensor 29 translates the position of the vehicle accelerator pedal to a requested engine speed, $N_{REF}$.

The ECM 20 can include a memory 23 which stores a variety of algorithms and constants necessary for determining the operating conditions of the engine 10. The ECM 20 also includes a fuel control module 25 that receives the $N_{ACT}$ signal 16, the $N_{REF}$ signal 28 and data from the memory 23 to determine an appropriate fueling command to be provided to the fuel system 12. In particular, the fuel control module 25 incorporates the engine speed governor that operates to modulate the fuel control signal 26 as a function of the difference between the actual engine speed $N_{ACT}$ and the expected engine speed $N_{REF}$.

One such engine speed control system is shown in U.S. Pat. No. 5,553,589, owned by the assignee of the present invention. The '589 Patent shows one type of speed control system that includes a variable droop feature. The general components of the speed control system in the '589 Patent, along with other prior art speed governors, is depicted in the control system block diagram FIG. 2. It is understood that the representations in FIG. 1 and 2 of this prior engine speed governor are relatively generic and for illustration purposes only. Specific details of the speed control system of the '589 Patent are left to the specification and figures of that patent, which information is incorporated herein by reference.

Turning now to FIG. 2, a fuel control module 25' is depicted. Specifically, the module 25' receives the reference speed signal $N_{REF}$, which is based upon the user controlled throttle position. The actual engine speed $N_{ACT}$ is provided on signal line 16 to a summing node 30. Specifically, the actual engine speed $N_{ACT}$ is subtracted from the reference speed value $N_{REF}$ to produce a speed error signal 31, $N_{ERR}$. This error signal 31 is indicative of the difference between the desired engine speed and the actual engine speed. This signal 31, $N_{ERR}$ is provided to a linear controller 32 that applies a transfer function C(s) to the error value. This linear controller can be of a variety of types, but most preferably is a PID controller. In the typical engine control system, the linear controller 32 generates a fuel control signal 26' that is provided to the fuel system 12 of the engine 10. In the prior systems, this fuel control signal corresponds to a degree of actuation of a flow control valve forming part of the fuel control system. In a typical installation, the fuel control signal 26' corresponds to a particular volume of fuel per stroke of the fuel control valve.

This fuel control signal 26' is provided to the engine 10, which can be approximated in the control system diagram of FIG. 2 by a transfer function G(s). The engine transfer function G(s) translates the fuel control signal 26' to an actual engine speed $N_{ACT}$.

For any engine speed control system, the engine 10 can be approximated by a transfer function G(s) as represented in the control system diagram of FIG. 3. In particular, the fuel system 12 of the engine can be represented by a fuel system delay 13. The delay 13 receives the fuel control signal 26 and translates that signal to a supply of fuel to the engine after a time delay L. This delay corresponds to the activation of the mechanical and fluid components of the fuel control system 12. The combustion process can be represented by the transfer function k in block 14. Specifically, the value k corresponds to the translation of fuel to engine torque produced by combustion of the fuel within the engine. In one specific example, the transfer function k can have a value of 5.1.

While the combustion of the fuel generates torque within the engine, this torque bears a predetermined relationship to the actual engine speed. Specifically, the torque load applied to the engine is subtracted from the torque generated at block 14 at summing node 19. This combined torque is then converted to rotational speed as a function of the inertia of the rotating components of the engine, which is represented by block 17. In an ideal engine, the actual engine speed $N_{ACT}$ would be a function of only those components. However, the rotating components of the engine generate a certain amount of friction torque, which is known to be a function of the engine speed. Thus, a transfer function C(N) is introduced at block 18 in a feedback loop from the output of block 17 to the summing node 19. This friction torque value is thus subtracted from torque load and the torque produced by combustion of the fuel.

The friction torque represented by the transfer function C(N) is a non-linear function of engine speed. Thus, it is known that one typical speed-torque curve has a hyperbolic shape centered on a specific low engine speed. Above that engine speed, the torque gradually increases. Below that engine speed, the friction torque dramatically increases. This great increase in friction torque is primarily due to the fact that at the lower engine speed oil pressure is lower, which means that less oil is circulating between the rotating components of the engine.

The friction torque transfer function C(N) can be approximated by an equation as a function of engine speed N using a linear regression analysis. Although the torque vs. speed curve is non-linear, the system can be linearized using a differential equation based upon the incremental change in engine speed due to a incremental change in commanded fueling to the fueling system 12. Thus, the following equation can be developed to simulate the engine 10, based upon the block diagram of FIG. 3:

$$J \cdot \Delta\dot{N}(t) = k \cdot \Delta F_{STOKE}(t-L) - \frac{\partial C(N)}{\partial N}\Delta N(t) \tag{1}$$

The DC gain of the linearized system is a ratio of the coefficients applied to $\Delta F_{STROKE}$ and $\Delta N$. In otherwords, the DC gain of the typical linearized system for controlling engine fueling can be represented by the following equation.

$$\text{DC_GAIN}(N) = \frac{k}{\frac{\partial C(N)}{\partial N}}. \tag{2}$$

As with most control systems, the sign of the DC gain can change. As depicted in FIG. 5, the DC gain is a function of engine speed for the linearized system represented by the above equations is indicated by the curves 25'. The DC gain changes sign in the illustrated embodiment at an engine speed of approximately 460 rpm. The linearized system has a negative feedback when the engine speed is above 460 rpm. On the other hand, the system has a positive feedback when the speed is below 460 rpm.

As the curves 25' demonstrate, this known engine speed control system becomes unstable when operated below a particular engine speed, in this case about 600 rpm. These effects can be a result of the non-linear relationship between engine speed and friction torque, for instance. According to the DC gain equation (2), the partial differential of the friction torque relative to engine speed $$\left[\frac{\partial C(N)}{\partial N}\right]$$

is in the denominator of the ratio. Thus, at a particular engine speed, the partial differential can equal zero, which means that the gain approaches infinity. In addition, at a lower engine speed, the sign of the partial differential will change, as reflected by the portion of the curve 25' below 460 rpm.

As the DC gain curve 25' of FIG. 5 demonstrates, the system is stable at engine speeds above about 600 rpm (although, this stability point may vary depending upon the particular engine and its friction torque feature). Thus, this prior engine speed control system performs very well at normal operating speeds—i.e. when the engine speed is in excess of 600 rpm.

A problem arises when the engine is to be operated at an idle condition. It is frequently desirable to have an idle speed that is below the speed at which the traditional linear controller is capable of sustaining. In the illustrated example of FIG. 5, the low limit speed is about 460 rpm, although operation at speeds below 600 rpm exhibits severe instability. At speeds below 600 rpm the engine speed control system is increasingly less capable of maintaining a constant speed. Thus, if it is desired to run the engine at a speed below the first threshold of 600 rpm, the operator must endure significant variations in engine speed.

More significantly, if it is desired to run the engine below the lowest threshold speed, namely 460 rpm, the traditional engine speed control system is incapable of operating in that manner. As indicated by the equations above, these limitations are not specifically imposed by the linear controller, such as controller 32 (see FIG. 2). Instead, these limitations are imposed by the dynamics of the engine 10 itself, and more specifically by the partial differential $$\left[\frac{\partial C(N)}{\partial N}\right].$$

There is therefore a significant need for an engine speed control system that is capable of sustaining stable speed control at low engine speeds. Moreover, this need extends to such a system that can account for dynamic changes between different engines.

One important link in an engine speed control system is the accuracy of the engine speed signal. In a typical system, as depicted in FIG. 7, a tone wheel 50 is driven from the engine camshaft. The tone wheel includes a plurality of teeth 52 evenly distributed around the circumference of the tone wheel at known angular intervals. A typical tone wheel includes 24 teeth 52. An additional tooth 54 can be provided to identify a top-dead-center position of a particular reference cylinder.

A sensor 60 is arranged to generate a signal 62 as each tooth passes. The signal 62 is fed to an amplifier and shaping circuitry 65 that can transform the analog signal to a squared pulse train signal. In one embodiment, this pulse train signal is fed to the ECM 20, which includes circuitry or software to calculate the engine speed from the pulse train information. One engine speed sensor configuration is disclosed in U.S. Pat. No. 5,165,271, which description is incorporated herein by reference.

For the purposes of the present disclosure, the circuitry 65 has been presumed to encompass circuitry and/or software modules normally resident within the ECM 20 that is needed to generate the speed signal 16 discussed above. These modules can include a timer and signal sample module that count the elapsed time between tooth passages, and then divides the angular distance between teeth by that elapsed time to generate the engine speed signal. In control circuit terms, the traditional speed sensor is a zero order sample and hold component with a half time delay.

Due to sensor eccentricity and tooth error, a sampled speed signal can contain disturbances superimposed over the pulse train. Typically, these errors are at the shaft speed and can lead to replicated frequency signals at multiples of the sensed and discretized signal. These replicated frequency components can be referred to as frequency aliasing. Under many conditions, this frequency aliasing does not pose a significant problem to the integrity of the speed sensor data and speed signal. However, in some circumstances, such as within a multi-sampling scheme in a speed control loop, the replicated frequencies of the disturbances are introduced into the low frequency domain where the speed control algorithms operate. Thus, the low frequency aliasing can cause surging and unwanted speed variation.

This problem can be particularly troublesome in a vehicle speed control system. The components of the vehicle speed control system can be similar to those depicted in FIG. 7, except that the tone wheel 50 is associated with the vehicle tailshaft. In one example, sampling disturbances can occur at about 34 Hz. Due to the frequency aliasing phenomena, these disturbances can be shifted to less than one Hz, which is sufficiently low to be active during the speed control processing.

One approach to addressing this signal noise problem is to utilize higher quality components—i.e., tone wheel and sensor. Of course, higher quality usually means greater expense. Another approach is to reduce the speed sampling rate to once per revolution. This approach introduces a large sampling delay and limits the sample rate, which translates to poor speed control performance, especially at low engine or vehicle speeds.

A need exists for a speed control system that eliminates or suppresses frequency aliasing that is introduced in a multi-sampling scheme, without sacrificing the sampling rate benefits. This need can best be served by a system that does not rely upon additional or more expensive hardware or circuitry.

SUMMARY OF THE INVENTION

In order to address these needs, the present invention contemplates an engine speed control system or governor that provides stable speed control at low engine idle speeds. In the preferred embodiment, speed error signal is generated from the difference between the actual engine speed and a commanded reference speed. This error signal is fed to a linear controller that generates a fuel flow signal. The fuel flow signal is in units of volume per unit time, preferably $cm^3$/min. The relationship between fuel flow rate and engine speed is nearly linear and eliminates the problems faced by prior linear controllers approaches based on fueling command values. More specifically, the fuel flow rate linear controller of the present invention does not experience a change in sign of the controller gain that is inherent in prior linear controllers.

In a further feature of the invention, the fuel flow rate signal generated by the linear controller is provided to a non-linear compensator that converts the flow rate signal to a fueling command signal. In the preferred embodiment, the fueling command signal is tuned to the particular fueling system of the engine. For example, the fueling command signal can be in units of volume per stroke, most preferably in $mm^3$/stroke. In one aspect of the invention, the non-linear compensator also receives the actual engine speed as an input for generating the fueling command signal.

In one embodiment, the non-linear compensator can utilize calibration values to improve the linearity of the output signal. Thus, a specific predetermined gain value can be applied. In addition, a number of speed thresholds can be implemented to avoid a divide by zero condition when the actual engine speed approaches zero. For example, minimum and maximum speed thresholds can be compared against the actual engine speed to provide a non-zero value to the non-linear compensator algorithm. In the preferred embodiment, this algorithm is a simple ratio of gain value to speed.

In the preferred embodiment, the non-linear compensator can be in the form of a calculated transfer function applied to the fuel flow rate signal. In an alternative embodiment, a look-up table can be maintained in a memory. The non-linear compensator can then read the fuel flow rate signal from the linear controller and the actual engine speed signal to extract a fueling command signal value from the table.

In a further aspect of the invention, a speed sensing system is provided that produces a more noise-free speed signal for use by the speed control system. In one embodiment, the sensing system includes a zero order sample and hold, and a first order sample and hold that operates on the output of the zero order holder. The first order holder alters the frequency response or transfer function of the sampling circuitry from the response experienced by the typical zero order holder. The frequency response of the first order holder is such that the magnitude of the disturbance signal at the replicated frequencies is significantly lower than for the traditional zero order holder. This reduced disturbance signal magnitude effectively suppresses the unwanted frequency aliasing when the disturbance frequency shifts to the lower domain.

One benefit of the present invention is that it significantly lowers the threshold speed at which the speed control system becomes unstable or unable to accurately maintain the commanded engine speed. A more specific benefit in this regard is that the system exhibits linear behavior at engine speeds lower than most engine low idle speeds.

One object of the present invention is to provide an engine speed controller that is capable of substantially linear and stable performance at low engine speeds. Another object is achieved by features of the invention that allow ready adaptation to a variety of engines and fueling control systems.

These and other benefits and objects can be discerned from the following written description and accompanying figures.

DESCRIPTION OF THE PREFERRED EMBODIMENTS

Figure 1:
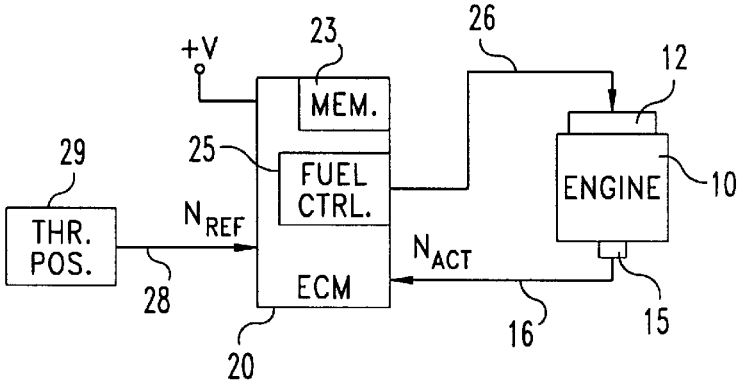
FIG. 1 is a block diagram of a system for controlling the operating speed of an internal combustion engine.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

The present invention contemplates an engine speed control system or engine speed governor that provides stable regulation of engine speed at low rpms. In brief, instead of using engine fueling in volume (cubic millimeters) per stroke, the present invention relies upon engine fueling flow rate (cubic centimeters per minute) as the foundation of the speed governor function. Thus, a linear controller receives at its input a speed error signal and produces as its output the fueling flow rate signal.

This flow rate value in $cm^3$/min. is then provided to a non-linear compensator. The compensator translates the fuel flow rate into a fueling system command, namely in units of $mm^3$/stroke. The compensator receives as its input not only the flow rate signal from the linear controller, but also a speed signal indicative of the actual engine speed. Thus, the compensator exhibits a non-linear correlation between the flow rate input signal and the fueling control output signal.

Figure 4:
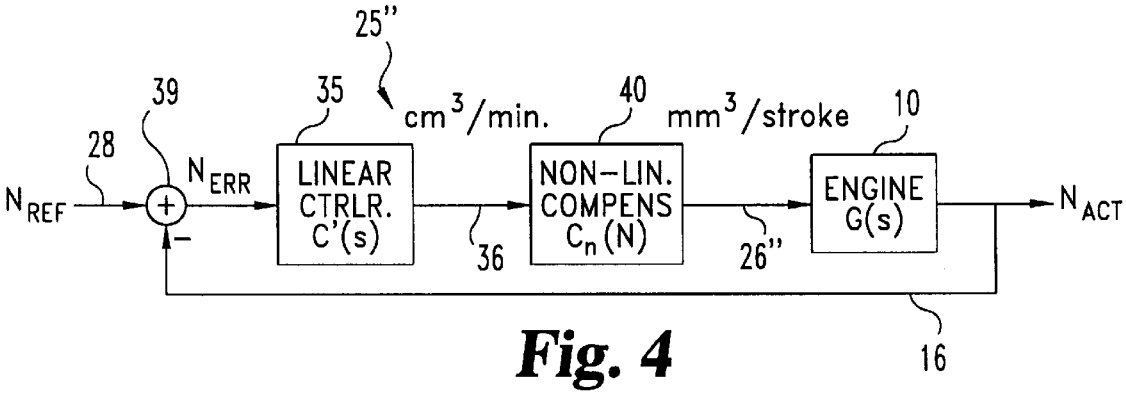
FIG. 4 is a control system block diagram of an engine speed governor in accordance with one embodiment of the present invention.

More specifically, the present invention contemplates an engine speed control system 25", as depicted in the control system block diagram of FIG. 4. It is understood that this control system or module can be implemented within the engine control module 20, as shown in FIG. 1. Preferably, the speed control system or engine speed governor 25" receives digital input signals and generates a fuel control signal 26" that is provided to the engine 10 and more specifically to the fuel control system 12 (FIG. 1).

As with the prior art systems, the engine speed governor or fuel control system 25" receives a reference speed signal 28, $N_{REF}$, that can be generated by the throttle position sensor 29 (FIG. 1). In addition, the actual engine speed signal 16, $N_{ACT}$, is fed to a summing node 39. The difference between the actual engine speed and the reference speed is obtained at that node and passed on as a signal $N_{ERR}$. This speed error signal $N_{ERR}$ is fed to a linear controller 35 that implements a transfer function C'(S). In the preferred embodiment, the linear controller 35 is a PID controller, although other controllers are contemplated, such as $H_2$, OCC, QFT, etc. The DC gains for the PID components can be calibrated so the transfer function C'(S) translates the speed error signal to the fuel flow rate units.

Figure 2:
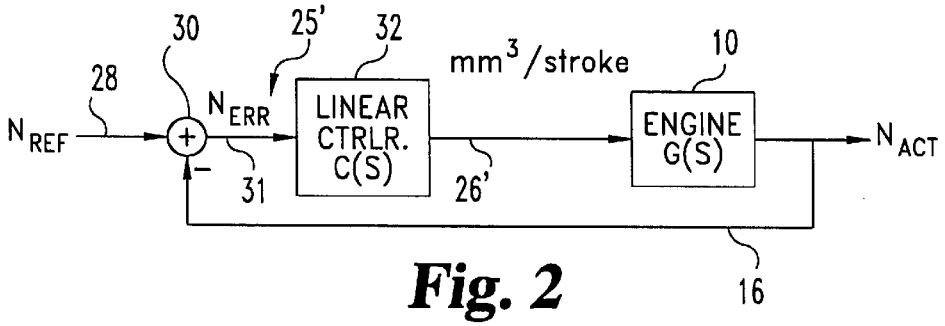
Fig. 2 (PRIOR ART)
FIG. 2 is a control system block diagram of one engine speed governor of the prior art.
Figure 6:
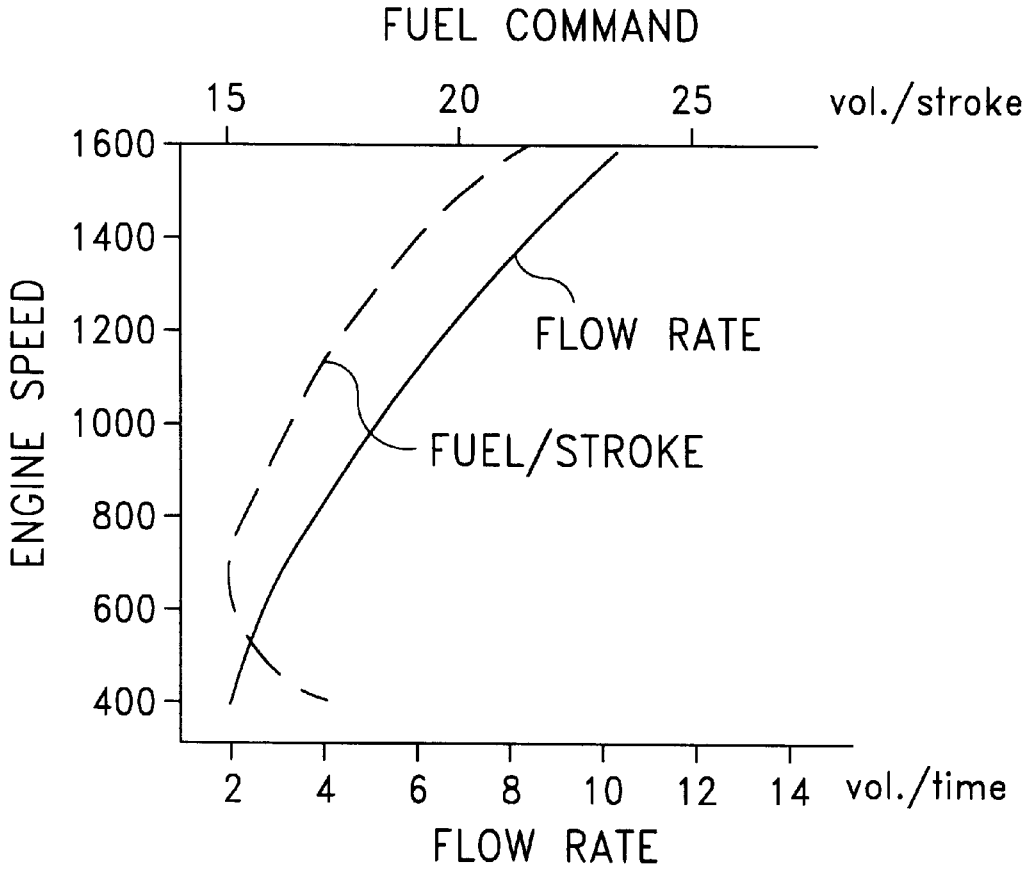
FIG. 6 is a graph of fueling flow rate and fueling command rate verses engine speed.

Unlike the linear controller 32 of the prior art system shown in FIG. 2, the linear controller 35 of the fuel control module 25" of the present invention correlates the speed error signal $N_{ERR}$ to an engine fueling flow rate in units of volume per time. In the most preferred embodiment, the output signal 36 from the linear controller 35 is in units $cm^3$/min. The engine fueling flow rate is used by the present invention because it exhibits a substantially linear relationship relative to engine idle speed. This generally linear characteristic is illustrated in the graph of FIG. 6. Also plotted on that graph is the commanded fueling amount in volume per stroke units as a function of engine speed.

As the graph illustrates, the commanded fueling amount (fuel/stroke) is a non-linear function of engine speed, approaching a hyperbolic function. On the other hand, fuel flow rate is represented by a uniformly increasing, nearly linear curve throughout the engine speed range. It can therefore be appreciated that incremental changes in engine speed, on the order of the magnitude of the speed error signal $N_{ERR}$, are substantially linearly related to changes in fuel flow rate. Thus, use of engine fueling flow rate as a starting point for the linear controller 35 is one feature of the present invention that increases the linearity and stability of the engine speed control function.

The fueling control module 25" also includes a non-linear compensator 40 that applies a transfer function $C_n(N)$ to the fuel flow rate signal 36. The compensator also receives the actual engine speed signal 16 as a second input. The compensator 40 then produces a commanded fueling signal 26" that is in the expected units of fuel volume per stroke. This signal 26" can be supplied directly to the engine 10, and most specifically to the fueling system 12. In the specific embodiment, the fueling command signal is in units of $mm^3$/stroke.

In one embodiment, the transfer function $C_N(N)$ can be in the form of a three-dimensional table with a plurality of discrete fueling flow rate values on one axis and discrete actual engine speed values (rpm) on another axis. The engine control module 20, and more specifically the fuel control module 25", can include table look-up instructions or commands to find the appropriate fueling command value from the table based upon the engine speed signal 16 and flow rate signal 36.

Most preferably, however, the transfer function for the non-linear compensator 40 can be an equation of the following form:

$$C_n(N) = \frac{1000 \cdot G}{3 \cdot \min(\max(N_{MIN}, N), N_{MAX})} \tag{3}$$

According to this equation, the constant G can be used as a gain factor to calibrate the non-linear compensator 40. The values $N_{MIN}$ and $N_{MAX}$ are calibration speeds that are used to avoid a zero denominator and to improve the linearity of the overall governor performance. In accordance with this equation, a comparison is made between the actual engine speed N and the minimum calibration value of $N_{MIN}$. The maximum of these two values is then compared against the calibration value $N_{MAX}$. The minimum value from this comparison is then multiplied by 3 and applied as the denominator in the equation. The equation (3) above is applicable to a known four stroke, six-cylinder engine. Other equations relating fueling flow rate to an engine fueling command in fuel/stroke are contemplated to suit a particular engine configuration.

One benefit of the present invention is realized by the separate linear controller 35 and non-linear compensator 40. The linear controller 35 can be specifically related to the engine, since the output from the controller is a signal indicative of fuel flow rate through the fuel control valve. The non-linear controller 40 relates this flow rate to a fueling command for a specific fueling system 12 and fuel control valve. Thus, the non-linear controller can be tailored to a particular fueling system configuration.

Figure 3:
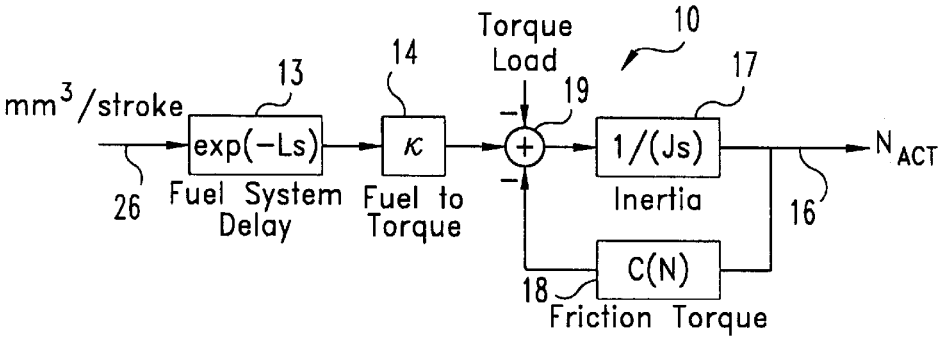
FIG. 3 is a control system block diagram of the dynamic components of an engine under speed control.

Perhaps the greatest benefit of the present invention is that the linearized system produces a DC gain that is significantly more manageable and acceptable than with prior systems. When applied to the control system model for the engine as shown in FIG. 3, the entire fuel control and engine system can be represented by the following differential equation:

$$J \cdot \dot{N}(t) = \frac{1000 \cdot G}{3 \cdot N} \cdot F_{FLOW}(t - L) - C(N(t)) \tag{4}$$

The value $F_{FLOW}$ is the commanded fuel rate signal 36 generated by linear controller 35 based upon the engine speed error signal $N_{ERR}$. The value C(N(t)) is the engine friction torque transfer function described above in connection with the control diagram of FIG. 3. The differential equation (4) can be linearized in the following manner:

$$J \cdot \Delta\dot{N}(t) = \frac{\partial f(N, F_{FLOW})}{\partial F_{FLOW}} \cdot \Delta F_{FLOW}(t - L) + \frac{\partial f(N, F_{FLOW})}{\partial N} \cdot \Delta N(t), \tag{5}$$

where $$f(N, F_{FLOW}) = \frac{1000 \cdot G}{3 \cdot N} \cdot F_{FLOW} - C(N).$$

The DC gain, then, of this new linearized system takes the following form:

$$\text{DC_GAIN}(N) = \left\{\frac{\partial f(N, F_{FLOW})}{\partial F_{FLOW}}\right\} \Big/ \left\{\frac{\partial f(N, F_{FLOW})}{\partial N}\right\}. \quad (6)$$

In each of these equations the value $F_{FLOW}$ is the magnitude of the signal 36 output from the linear controller 35—i.e., fuel flow per unit time, typically in units of $mm^3$/min. As with the prior control systems, the DC gain of the present engine speed governor system is unstable at a particular low engine speed. However, in accordance with the present invention, this low engine speed is significantly reduced from any prior art engine speed governor system.

Figure 5:
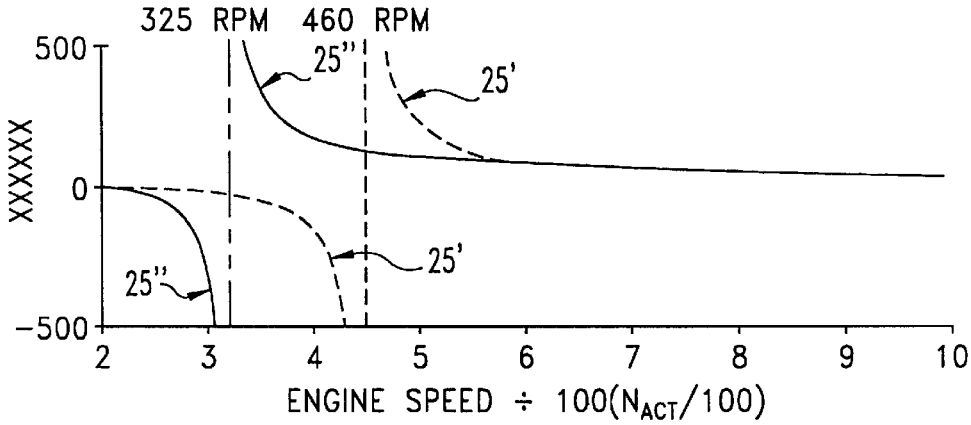
FIG. 5 is a graph of DC gain as a function of engine speed for a prior art linear controller and for an engine speed governor according to one embodiment of the present invention.

Thus, as shown in FIG. 5, the DC gain produced by the linear controller 35 of the present invention is represented by the curves 25". As is clear from the figures, the curves 25" become unstable at 320 rpm, which is 135 rpm below the prior art system represented by curves 25'. Moreover, the DC gain remains very stable down to about 450 rpm, which is well below the 600 rpm stability threshold of the prior art system. It is therefore apparent that the present invention provides a much more accurate and stable low engine speed governor than any prior speed control system. This same performance can be expected for a wide range of engine types having widely varying friction torque transfer function values.

In a further aspect of the invention, the standard idle speed governor (such as the prior art governor shown in FIG. 2) can be used when the engine idle speed is above the maximum calibration value (i.e., $N_{MAX}$). When the idle engine speed drops below that threshold value, the fuel control system 25" of the present invention can be invoked.

In accordance with one specific embodiment of the invention, the speed calibration values used in the non-linear compensator transfer function $C_N$ can be $N_{MIN}$=350 rpm and $N_{MAX}$=700 rpm. Tests with this specific configuration demonstrate that the engine speed control system 25" yields a positive open-loop gain at engine speeds above 400 rpm, and speed control errors of less than one percent at idle speeds of 450–500 rpm.

The speed governor system 25 of the present invention presents significant advantages over prior linear controller systems. For instance, the linear controller 35 of the inventive system translates the speed error signal $N_{ERR}$ to fuel flow rate, which is inherently more closely a linear function of engine speed than the fuel/stroke. Moreover, the fuel flow rate curve shown in FIG. 6 demonstrates that the DC gain of the linear controller will not change sign at engine speeds well below 400 rpm.

Another advantage resides in the ability of the speed control governor 25" to account for the non-linear impact of friction torque on engine speed. In the traditional speed control system represented in FIG. 2, engine friction torque dominates the control system response at lower engine speeds. The present invention recognizes this phenomenon and accounts for this non-linearity with the linear controller 35 and non-linear feedback-based compensator 40.

In a further aspect of the invention, a speed sensing system is provided that yields a substantially noise or disturbance free speed signal for use by the speed control system. In the illustrated embodiment, the speed sensing system is described in connection with sensing engine speed; however, the same principles can be applied to other sensing systems, such as vehicle speed, time-based control sensing, etc., that are susceptible to frequency aliasing conditions.

Figure 7:
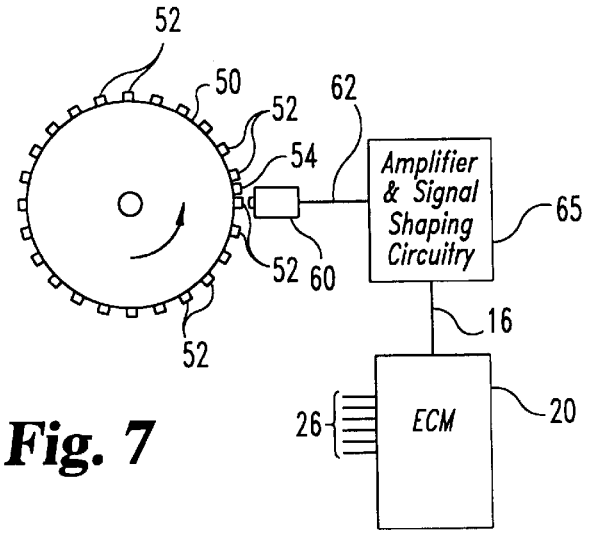
FIG. 7 is a diagrammatic illustration of a speed sensing apparatus for providing engine speed signals to the speed controller of the present invention.

In particular, this feature of the invention contemplates circuitry and software that can reside within the shaping circuitry 65 shown in FIG. 7, and/or in the ECM 20. Most preferably, the invention contemplates a software solution to the speed signal disturbance and frequency aliasing problem discussed in the Background. In this instance, the speed signal 16 is generated internal to the ECM; however, for simplicity, the signal 16 is depicted as being generated by the shaping circuitry 65.

Figure 8:
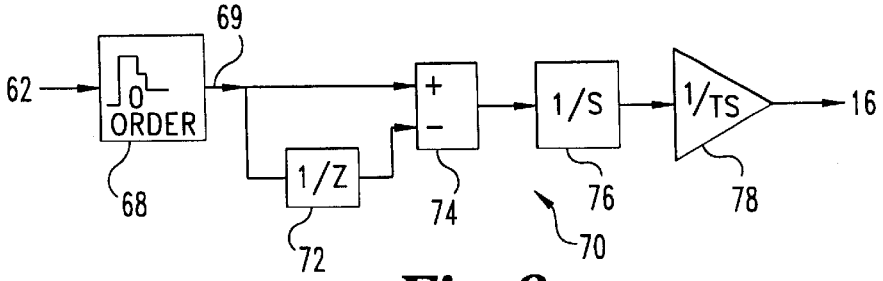
FIG. 8 is a block diagram of components of a speed sensing apparatus according to one embodiment of the present invention.

The sensor 60 generates a pulse or signal 62 at each passage of a tooth 52 of the tone wheel 50. This feature of the invention contemplates converting these periodic pulses into a signal 16 indicative of the speed (engine, vehicle, etc.) that can be used by various routines within the ECM 20. Known speed sensing systems rely upon a zero order sample and hold component, such as holder 68 depicted in FIG. 8. This zero order holder 68 produces a speed signal 69 that is provided to the first order holder 70. The first order holder 70 can be characterized by a delay element 72 that delays the speed signal 69 by one cycle. The delayed signal is then subtracted from the current speed signal at a summing node 74. The output form the summing node is fed to an integrator 76 and gain element 78 where the product of the integration is divided by the sampling period. The output from the gain element 78 is the speed signal 16 utilized by the control routines of the ECM 20.

Figure 9:
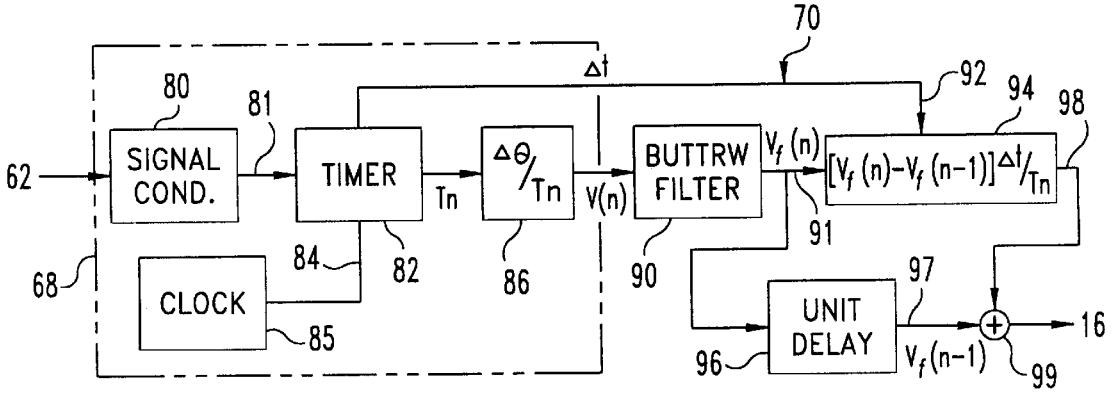
FIG. 9 is a block diagram of the speed sensing system.

Referring to FIG. 9, the speed sensing system is depicted in more detail. The zero order holder 68 can include a signal conditioner 80 that receives the signal 62 from the sensor 60 (FIG. 7). The signal conditioner 80 preferably produces a pulse train 81 from the analog sensor signal. This pulse train is fed to a timer/counter 82 that determines the length of time between pulses. In a specific example, a clock 85 can provide clock signals 84 to the timer/counter 82. The timer/counter can be of known design to count the number of clock pulses 84 received between each pulse signal 81.

The output of the timer/counter 82, time value $T_n$, is fed to a calculation module 86 that calculates an unfiltered speed V(n) as a function of the time value and the known angular distance between teeth 52 of the tone wheel 50. This speed signal V(n) is the output of the zero order holder 68 that is provided to the first order holder 70 in accordance with the present invention. In the preferred embodiment, the first stage of the holder 70 is a Butterworth filter 90 that reduces sensor noise attributable to eccentricity and tooth error. Most preferably, the Butterworth filter 90 has a cut-off frequency that is proportional to the speed sensor revolutions.

The filtered speed signal $V_f(n)$ is provided to a unit delay module 96 and an incremental calculation module 94. The delay module 96 holds the filtered signal until the next speed signal is generated. The incremental calculation module 94 receives an additional input from the timer/counter 82. Thus, in one aspect of the invention, a signal 92 is provided corresponding to the value, or the time duration between the last sample and current time. The incremental calculation module performs the following calculation:

$$\sum [V_f(n) - V_f(n-1)] \frac{\Delta t}{T_n} \quad (7)$$

The unit delay signal 97 and the output of the calculation module 98 are fed to a summing node 99. The output of this operation is the processed speed signal 16 that has been conditioned to substantially eliminate any frequency aliasing. The output of the first order holder 70 is, in essence, the current sampled value plus the error integration between the current and last samples divided by the sample period.

The present invention provides an important advantage in that the first order holder 70 can be entirely software based. Most specifically, the incremental calculation module 94, the unit delay component 96 and the summing node 99 can be embodied in software instructions resident within the ECM 20. The output of the Butterworth filter, $V_f(n)$, can de digitized for use by the ECM software, as can the $\Delta t$ value generated by the timer/counter 84.

The reduction in frequency aliasing accomplished by the sensing system of the present invention is a function of the sampling frequency relative to the bandwidth of the sensor signal. For example, a ten times reduction in aliasing can be experienced when the sampling frequency is ten times faster than the signal bandwidth. Likewise, four times increase in efficiency can be realized with a sampling rate five times faster than the bandwidth.

The addition of the first order holder 70 by the present invention also introduces an additional time delay to the output speed signal 16 than experienced by the traditional sensing system. However, this additional delay is sufficiently small relative to the sensor signal bandwidth that it presents no substantial problem to downstream routines that utilize the speed signal. In addition, the holder 70 introduces a phase shift relative to the typical zero order holder. This phase shift can be eliminated by adding a predictor element to the first order holder 70.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A method for controlling the speed of an internal combustion engine having an engine speed sensor for generating an engine speed signal indicative of the actual engine speed and a fuel system responsive to a fuel control signal to fuel the engine, the method comprising the steps of:

generating a reference signal indicative of a reference engine speed;

comparing the engine speed signal to the reference signal to yield an error signal;

obtaining a fueling flow rate signal as a function of the error signal, the magnitude of the flow rate signal being indicative of a volume of fuel per unit time; and generating a fuel control signal as a function of the fueling flow rate signal and the engine speed signal.

2. The method for controlling engine speed according to claim 1, wherein said step of obtaining a fueling flow rate signal includes passing the error signal through a linear controller to apply a transfer function to the error signal.

3. The method for controlling engine speed according to claim 2, wherein the linear controller is a PID controller.

4. The method for controlling engine speed according to claim 1, wherein said step of generating a fuel control signal includes providing the flow rate signal and the engine speed signal to a non-linear compensator.

5. The method for controlling engine speed according to claim 4, wherein the non-linear compensator is operable to divide the flow rate signal by the engine speed signal.

6. The method for controlling engine speed according to claim 5, wherein the non-linear compensator is operable to apply a predetermined gain to the flow rate signal.

7. The method for controlling engine speed according to claim 5; wherein said step of generating a fuel control signal includes replacing the engine speed signal with a first threshold speed signal if the engine speed signal is less than the first threshold speed signal.

8. The method for controlling engine speed according to claim 7, wherein said step of generating a fuel control signal includes replacing the engine speed signal with a second threshold speed signal if the engine speed signal is greater than the second threshold speed signal.

9. The method for controlling engine speed according to claim 8, wherein said step of generating a fuel control signal includes replacing the engine speed signal with a first threshold speed signal if the engine speed signal is less than the threshold speed signal.

10. The method for controlling engine speed according to claim 9, wherein the first threshold speed signal and the second threshold speed signal are calibrated to envelope a low idle speed for the engine.

11. A system for controlling the speed of an internal combustion engine having an engine speed sensor for sensing actual engine speed and a fuel system having a flow control valve responsive to a fuel control signal to supply a quantity of fuel to the engine; the system comprising:

means for generating an error signal as a function of the difference between the actual engine speed and a reference speed;

a linear controller operable to generate a fuel flow signal in response to the error signal, said fuel flow signal indicative of a fuel volume per unit time; and means for converting said fuel flow signal to a fuel control signal as a function of the actual engine speed, wherein said fuel control signal is indicative of a volume of fuel per actuation of the flow control valve of the fuel system.

12. The system for controlling the speed of an engine according to claim 11, wherein said linear controller is a PID controller.

13. The system for controlling the speed of an engine according to claim 11, wherein said means for converting includes a non-linear compensator receiving said fuel flow signal and the engine speed as inputs.

14. The system for controlling the speed of an engine according to claim 13, wherein said linear controller includes software operable to apply a transfer function $C_n(N)$ to said fuel control signal, said transfer function being of the form;

$$C_n(N) = \frac{1000 \cdot G}{3 \cdot \min(\max(N_{MIN}, N), N_{MAX})},$$

where G is a predetermined gain value, N is the actual engine speed, and $N_{MIN}$ and $N_{MAX}$ are calibration speed values.

15. The system for controlling the speed of an engine according to claim 14, wherein said calibration speed values envelope a low idle speed for the engine.

16. The system for controlling the speed of an engine according to claim 11, wherein said means for converting includes:

a three-dimensional table maintained in a memory, said table consisting of values for said fuel control signal as a function of said fuel control signal and the engine speed; and a table look-up processor for extracting a fuel control signal value based on said inputs to said means for converting.

17. A system for controlling the speed of an internal combustion engine having an engine speed sensor for generating a signal indicative of the actual engine speed and a fuel system with a flow control valve responsive to a fuel control signal to supply a quantity of fuel to the engine, the system comprising:

means for generating an error signal as a function of the difference between the actual engine speed and a reference speed;

a linear controller receiving said error signal as an input and operable to generate a fuel flow signal as a substantially linear function of said error signal, said fuel flow signal indicative of a fuel volume per unit time; and a non-linear compensator receiving said fuel flow signal and said actual engine speed signal as inputs and operable to generate a fuel control signal as a function of said fuel flow signal and the actual engine speed.

* * * * *

UNITED STATES PATENT AND TRADEMARK OFFICE

CERTIFICATE OF CORRECTION

PATENT NO. : 6,202,629 B1
DATED : March 20, 2001
INVENTOR(S) : G. George Zhu and Albert E. Sisson It is certified that error appears in the above-identified patent and that said Letters Patent is hereby corrected as shown below:

Title page:
-- Assignee: Cummins Engine Company, Inc., Columbus, Indiana. --

Signed and Sealed this

Eighteenth Day of September, 2001

*Attest:*

Nicholas P. Godici

NICHOLAS P. GODICI
*Acting Director of the United States Patent and Trademark Office*

*Attesting Officer*